US011569603B2

(12) United States Patent
Seipel et al.

(10) Patent No.: US 11,569,603 B2
(45) Date of Patent: Jan. 31, 2023

(54) ELECTRICAL CONTACT FOR MATING WITH A MATING CONTACT

(71) Applicant: TE Connectivity Germany GmbH, Bensheim (DE)

(72) Inventors: Volker Seipel, Bensheim (DE); Waldemar Stabroth, Mommenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 140 days.

(21) Appl. No.: 16/559,775

(22) Filed: Sep. 4, 2019

(65) Prior Publication Data

US 2020/0076105 A1 Mar. 5, 2020

(30) Foreign Application Priority Data

Sep. 4, 2018 (DE) ..... 102018215025.7

(51) Int. Cl.
*H01R 13/11* (2006.01)
*H01R 13/03* (2006.01)
(Continued)

(52) U.S. Cl.
CPC ..... *H01R 13/113* (2013.01); *H01R 4/029* (2013.01); *H01R 4/62* (2013.01); *H01R 13/03* (2013.01); *H01R 43/16* (2013.01)

(58) Field of Classification Search
CPC ..... H01R 13/03; H01R 13/113; H01R 4/029; H01R 4/58; H01R 4/62; H01R 43/16;
(Continued)

(56) References Cited

U.S. PATENT DOCUMENTS 6,451,449 B2 * 9/2002 Asakura ..... C23C 28/023 439/865
8,403,714 B2 * 3/2013 Nakata ..... H01R 4/184 439/877

(Continued)

FOREIGN PATENT DOCUMENTS

JP 2014089810 A 5/2014
JP 2014164927 A 9/2014
WO 2013065803 A1 5/2013

OTHER PUBLICATIONS

European Search Report, Application No. 19194147.5-1201, dated Jan. 20, 2020, 8 pages.

(Continued)

*Primary Examiner* — Oscar C Jimenez
*Assistant Examiner* — Paul D Baillargeon
(74) *Attorney, Agent, or Firm* — Barley Snyder

(57) ABSTRACT

An electrical contact for mating with a mating contact includes an aluminum body extending along a longitudinal axis and formed of an aluminum or an aluminum alloy, a contact zone disposed on a surface of the aluminum body and adapted to be electrically connected to a mating contact, and a contact spring connected to the aluminum body and having a contact region contacting the mating contact. The aluminum body has a connecting portion adapted to be connected to an aluminum conductor. The contact zone is formed from a material that is more creep-resistant than the aluminum body. The contact spring at least partially rests on the contact zone and is formed from a material that is harder than the aluminum body.

15 Claims, 1 Drawing Sheet

(51) Int. Cl.
*H01R 4/02* (2006.01)
*H01R 4/62* (2006.01)
*H01R 43/16* (2006.01)

(58) Field of Classification Search
CPC . H01R 43/18; H01R 4/56; H01R 4/68; H01R 4/01; H01R 13/02; H01R 13/2492; H01R 4/48
See application file for complete search history.

(56) References Cited

U.S. PATENT DOCUMENTS 8,419,486 B2 * 4/2013 Tyler ..... H01R 13/113 439/842
8,827,754 B2 * 9/2014 Lee ..... H01R 13/187 439/845
9,318,815 B2 * 4/2016 Mitose ..... C25D 11/08
9,716,332 B1 * 7/2017 Wimmer ..... H01R 13/113
2008/0146091 A1 * 6/2008 Tyler ..... H01R 13/187 439/843
2011/0114363 A1 * 5/2011 Schloms ..... H01R 43/16 174/117 F
2012/0156947 A1 * 6/2012 Tyler ..... H01R 13/113 439/842
2016/0336662 A1 * 11/2016 Ooba ..... H01R 43/0207
2016/0359245 A1 * 12/2016 Aoki ..... H01R 4/62
2017/0331212 A1 * 11/2017 Doren ..... C25D 5/48
2018/0062294 A1 * 3/2018 Curran ..... G06F 1/1633
2018/0183165 A1 * 6/2018 Balser ..... H01R 13/434
2019/0044267 A1 * 2/2019 Lui ..... H01R 24/66
2019/0190178 A1 * 6/2019 Glick ..... H01R 13/113

OTHER PUBLICATIONS

Translation of JP2014164927, dated Sep. 8, 2014, 15 pages.
Translation of JP2014089810, dated May 15, 2014, 15 pages.
Translation of WO2013065803, dated May 10, 2013, 22 pages.

* cited by examiner

ELECTRICAL CONTACT FOR MATING WITH A MATING CONTACT

CROSS-REFERENCE TO RELATED APPLICATIONS

This application claims the benefit of the filing date under 35 U.S.C. § 119(a)-(d) of German Patent Application No. 102018215025.7, filed on Sep. 4, 2018.

FIELD OF THE INVENTION

The present invention relates to an electrical contact and, more particularly, to an electrical contact adapted to connect to an aluminum conductor.

BACKGROUND

Copper contacts made of copper or a copper alloy are used to connect an electrical conductor to a mating contact. These copper contacts have a high weight and high material costs. However, in particular in the automobile industry, especially in the case of large conductor cross-sections as are required in electric vehicles, a low weight is desirable. Therefore, copper conductors, for example copper cables, are increasingly being replaced by aluminum conductors made of aluminum or an aluminum alloy.

The copper contact remains desirable due to the mechanical stability of copper in order to generate a necessary contact normal force with the mating contact. The linking of the copper contact to the aluminum conductor, however, is very difficult. In the case of electrical contacts with a high material thickness, great difficulties have arisen, in particular with the copper contacts, when preparing the contact for the connection to the aluminum conductor. Galvanically coating the copper contact with high material thickness is costly.

SUMMARY

An electrical contact for mating with a mating contact includes an aluminum body extending along a longitudinal axis and formed of an aluminum or an aluminum alloy, a contact zone disposed on a surface of the aluminum body and adapted to be electrically connected to a mating contact, and a contact spring connected to the aluminum body and having a contact region contacting the mating contact. The aluminum body has a connecting portion adapted to be connected to an aluminum conductor. The contact zone is formed from a material that is more creep-resistant than the aluminum body. The contact spring at least partially rests on the contact zone and is formed from a material that is harder than the aluminum body.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
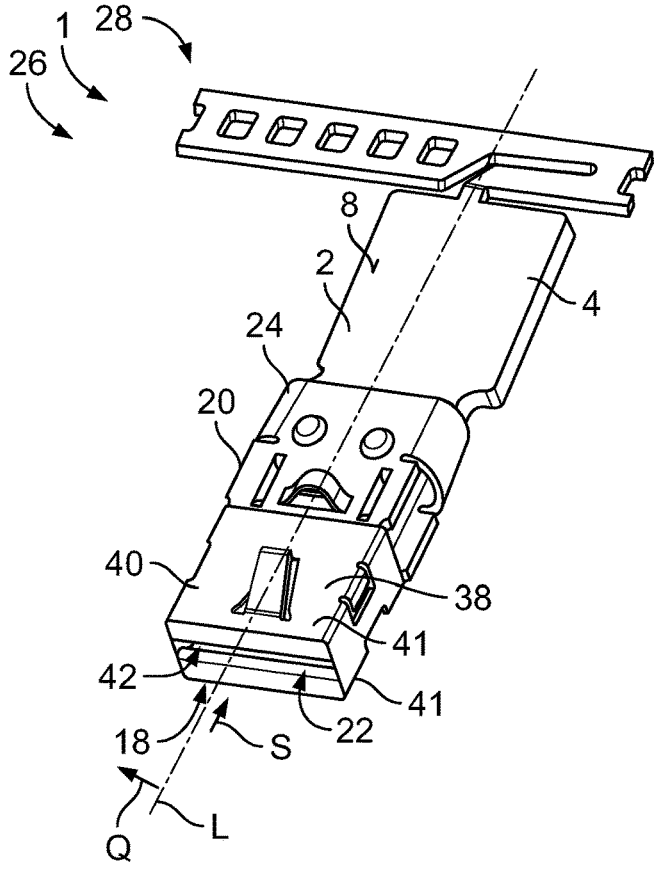
FIG. 1 is a perspective view of an electrical contact according to an embodiment.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art.

An electrical contact 1 according to an embodiment is shown in FIG. 1. A contact arrangement 3 according to an embodiment, including an aluminum conductor 6 connected to the electrical contact 1, is shown in FIG. 2.

Figure 2:
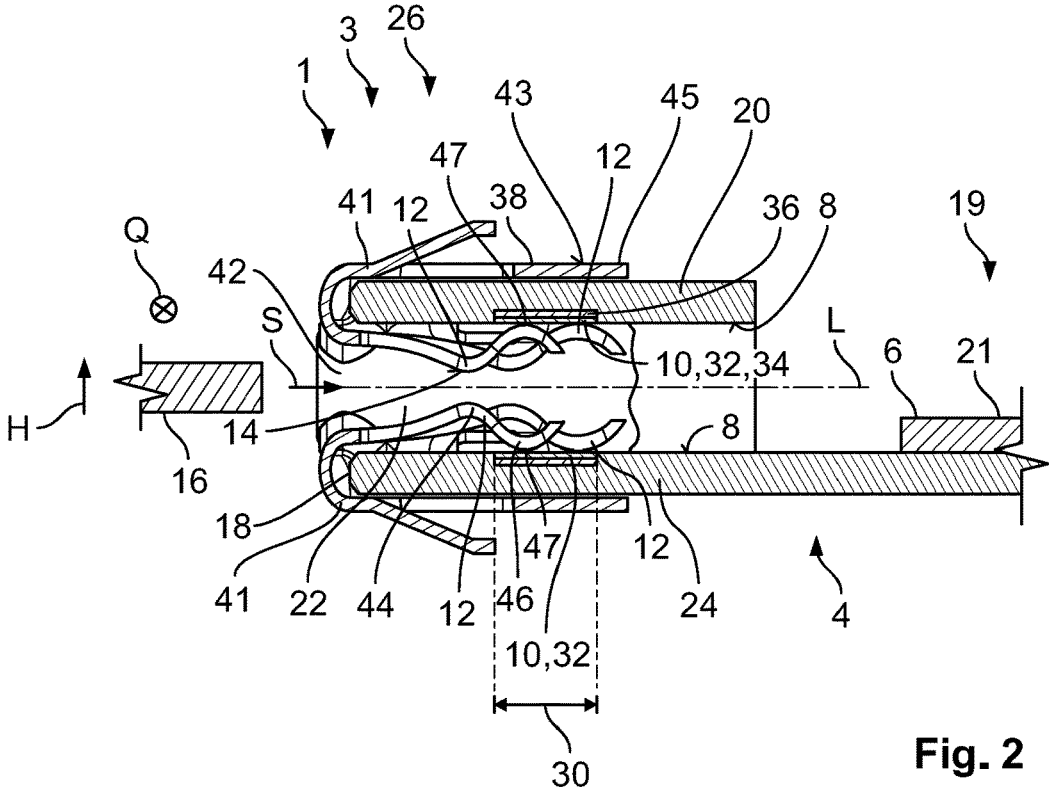
FIG. 2 is a sectional side view of a contact arrangement including the electrical contact.

The electrical contact 1, as shown in FIGS. 1 and 2, includes an aluminum body 2, extending along a longitudinal axis L, made of aluminum or an aluminum alloy. An aluminum alloy includes all alloys in which aluminum is the main component. The electrical contact 1 has a connecting portion 4 for connection to an aluminum conductor 6, a contact zone 10 arranged on a surface 8 of the aluminum body 2, and at least one contact spring 12, connected to the aluminum body 2, with a contact region 14 for contacting a mating contact 16.

In an embodiment, as shown in FIGS. 1 and 2, the aluminum body 2 is formed from an aluminum/magnesium alloy $AlMg_3$ 24. The aluminum body 2 is formed as a stamped-bent part 26. FIG. 1 shows a stamped strip 28, with only an electrical contact 1 being shown. A plurality of electrical contacts 1 disposed in a row beside one another can be arranged on the stamped strip 28, as a result of which a simple and automatable mass production at least of the aluminum body 2 is possible. In an embodiment, the aluminum body 2 has no form-fitting elements.

As shown in FIGS. 1 and 2, the aluminum body 2 has, at a free end 18, the shape of a socket 20, which surrounds a socket cavity 22, for receiving the mating contact 16. The connecting portion 4 extends along the longitudinal axis L from the socket cavity 22 in the direction away from the free end 18. At the connecting portion 4, the electrical contact 1 is connected to the aluminum conductor 6.

As shown in FIG. 2, the aluminum conductor 6 is affixed onto the surface 8 of the connecting portion 6 by a welded connection 19, in particular an ultrasound welded connection or a friction welding. In another embodiment, the aluminum conductor 6 can also be connected to the connecting portion 4 by a crimp connection; the connecting portion 4 can be provided with a crimping sleeve, which spans an arc over the connecting portion 4 in which the aluminum conductor 6 can be plugged. The crimping sleeve can then be squeezed, as a result of which the connection between the aluminum conductor 6 and the electrical contact 1 can be strengthened. In an embodiment, the aluminum conductor 6 can be connected to the connecting portion 6 in an integrally bonded and/or form-fitting manner.

The aluminum conductor 6 can, for example, be an aluminum cable 21 made of aluminum or an aluminum alloy. The aluminum cable 21, in an embodiment, has up to 99.7% aluminum.

As shown in FIGS. 1 and 2, in a plane arranged transverse to the longitudinal axis L, the socket 20 has a substantially rectangular cross-section. The socket 20 is open in the direction of the longitudinal axis L. In a longitudinal portion 30 extending along the longitudinal axis L, two surfaces 8 are arranged which point towards one another and which transversely delimit the socket cavity 22 in a height direction H, contact zones 10.

The contact zones 10 are formed from a material that is more creep-resistant than the aluminum body 2. In the shown embodiment, the contact zones 10 are made of a noble metal 32, such as a silver 34 and applied onto the surface 8 by roll-cladding. The contact zone 10 can alternatively be made of an alloy of a noble metal 32, such as a silver alloy. In other embodiments, the contact zone 10 can be formed from other noble metals 32 or noble metal 32 alloys such as gold or gold alloys or palladium or palladium alloys. Through the use of a contact zone 10 made of a noble metal or a noble metal alloy, surface corrosion on the contact zone 10, which can lead to a reduction in the electrical conductivity, is avoided. Alternatively, the contact zone 10 can be formed from tin or tin alloys, in particular in the case of applications in the lower temperature range, i.e. below approximately 120° C.

In order to save on the costs for the relatively expensive material of the contact zone 10, an intermediate layer 36 made of copper or a copper alloy is arranged between the contact zone 10 and the surface 8 in the height direction H, as shown in FIG. 2. The intermediate layer 36 can be applied onto the surface 8 by roll-cladding, before the contact zone 10 is applied onto the intermediate layer 36. As an alternative to the roll-cladding, both the contact zone 10 and the intermediate layer 36 can be applied by a chemical-vapor deposition, in particular by an electron beam, or a galvanic deposition. In an embodiment, the intermediate layer 36 and the contact zone 10 can be applied directly onto the stamped strip 28 as stripes prior to the bending, which is advantageous for an industrial manufacture of stamped-bent parts 26 in large quantities.

With the intermediate layer 36, the application of the contact zone 10 can be simplified since the composition and material thickness of the intermediate layer 36 can be optimized. Furthermore, the intermediate layer 36 can prevent the aluminum from the aluminum body 2 from creeping into the contact zone 10. Furthermore, through a shaping of the contact zone 10 from a noble metal, a surface corrosion, which can lead to a reduction in the electrical conductivity, can be prevented. The contact zone 10 is arranged along the longitudinal axis L flush with the surface 8, as a result of which no undesired abrasion and resulting increased wear occurs at the transition between the surface 8 and the contact zone 10 when sliding along the longitudinal axis L. In an embodiment, the material thickness of the contact zone 10 can be between approximately 2 μm and approximately 10 μm thick and the material thickness of the intermediate layer 36 can be between approximately 10 μm and approximately 20 μm thick.

The contact springs 12, as shown in FIGS. 1 and 2, extend away from a coupling region 38 in the direction of the longitudinal axis L. The coupling region 38 is shaped as a sleeve 40, which is placed onto the free end 18 of the aluminum body 2 that faces away from the connecting portion 4. The coupling region 38 can, for example, grip around, transverse to the longitudinal axis, an end of the aluminum body 2 facing away from the connecting portion 4. The coupling region 38 and the aluminum body 2 can have catch mechanisms, for example a catching clip, which are complementary to one another and which catch into place with a window or a notch, in order to prevent the coupling between the contact spring 12 and the aluminum body 2 from being released. In particular in vehicle applications, the electrical contact 1 is exposed to high vibration stresses and/or impact stresses, which, without the catch mechanisms, can lead to the coupling being released.

As shown in FIGS. 1 and 2, the sleeve 40 can be coated, at least on its outer surface 43 facing away from the aluminum body 2, with a corrosion-resistant coating 45, for example made of a noble metal such as silver. In the shown embodiment, both the supporting surface 47 of the contact spring 12, with which the contact spring 12 rests on the contact zone 10, and the contact region 14 are coated with a noble metal, such as silver. The coating 45 and the contact zone 10 are formed from the same material in an embodiment, as a result of which a contact corrosion can be prevented.

At one side 41 of the sleeve 40 arranged in the height direction H, a pair of undulating contact springs 12 extends away in the direction of the connecting portion 4 and are curved around the free end 18 and protrude into the socket cavity 22, as shown in FIG. 2. The opposing contact springs 12 delimit a receptacle 42 in the height direction H, into which the mating contact 16 can be plugged in a plugging direction S which runs substantially parallel to the longitudinal axis. The contact springs 12 of a pair are arranged beside one another in a transverse direction Q transverse to the height direction H and transverse to the longitudinal axis L, wherein they are offset in relation to one another in the direction of the longitudinal axis L. In other words, a contact spring 12 protrudes along the longitudinal axis L more deeply into the socket cavity 22 than the contact spring 12 arranged alongside in the transverse direction.

The contact springs 12 are made of a material that is mechanically and thermally more relaxation-resistant and stable than the aluminum or the aluminum alloy, for example stainless steel or copper, such as a copper alloy. The material of the contact spring 12 is harder than the aluminum body 2. The contact springs 12, as shown in FIG. 2, have an undulating shape with a first curvature 44 directed towards the opposite side 41 and a second curvature 46 facing away from the opposite side 41. The first curvature 44 delimits the receptacle 42 in the height direction H and has the contact region 14 for contacting the mating contact 16. The contact springs 12 rest with the second curvature 46 on the contact zone 10.

When a mating contact 16 is plugged in, the flow of current is conducted from the mating contact 16 via the contact springs 12 to the contact zone 10 and absorbed by the contact zone 10. Through the creep resistance of the contact zone 10, wear due to creepage is reduced. According to the exemplary configuration, the contact zone 10 is formed from silver, as a result of which surface corrosion, which could impair the electrical conductivity of the contact zone 10, is avoided. The flow of current is then guided from the contact zone 10 via the aluminum body 2 to the aluminum conductor 6. The contact normal force for contacting the mating contact 16 is generated by the contact springs 12, as a result of which the contact normal force with which the mating contact 16 is contacted is not generated by the aluminum body 2.

Through the plugging-in of the mating contact 16, the contact springs 12 are elastically deflected between the contact region 14 and the contact zone 10 and pressed against the contact zone 10. The contact zone 10 is made of a mechanically robust material, such as a noble metal, for example, as a result of which the contact zone 10 can withstand the pressing force of the contact springs 12 without yielding and is not abraded by a friction between the contact springs 12 on the contact zone 10 arising as a result of a relative movement.

With the electrical contact 1, particularly simple linking between the aluminum conductor 6 and the contact 1 is possible, without any additional processing of the contact 1 prior to the connecting. Since both components are made substantially from the same material, it is possible to connect the aluminum conductor 6 directly to the contact 1 without risking contact corrosion. Because the contact 1 has an aluminum body 2 with a connecting portion 4 for connecting to the aluminum conductor 6, it is possible to avoid difficulties even in the case of an electrical contact 1 with high material thickness. With the contact 1, a more lightweight alternative which is inexpensive compared to the copper contacts known from the prior art is created due to the lower material costs and mass of aluminum compared to copper. The aluminum body 2 leads to savings in terms of weight and material costs compared to the currently known electrical contacts, for example, copper contacts.

The contact to the mating contact 16 is generated via the at least one contact spring 12, as a result of which the aluminum body 2 is subjected to less strong mechanical stress. The flow of current is absorbed by the contact zone 10 via the at least one contact spring 12. Through the contact zone 10 which is more creep-resistant compared to the aluminum body 2, long-term contacting of the mating contact 16 can be achieved without loss of the contact quality and the wear on the electrical contact 1 can be reduced.

What is claimed is:

1. An electrical contact for mating with a mating contact, comprising:

an aluminum body extending along a longitudinal axis and formed of an aluminum or an aluminum alloy, the aluminum body has a connecting portion adapted to be connected to an aluminum conductor;

a contact zone disposed on a surface of the aluminum body and adapted to be electrically connected to a mating contact, the contact zone is formed from a material that is more creep-resistant than the aluminum body, the contact zone is arranged flush with the surface of the aluminum body;

an intermediate layer arranged between the aluminum body and the contact zone, the intermediate layer is formed of a different material than the contact zone and the aluminum body; and a contact spring connected to the aluminum body and having a contact region contacting the mating contact, the contact spring at least partially rests on the contact zone and is formed from a material that is harder than the aluminum body, the material of the contact spring is different from the material of the contact zone.

2. The electrical contact of claim 1, wherein the aluminum body is a stamped-bent part.

3. The electrical contact of claim 1, wherein the aluminum body is formed of an aluminum/magnesium alloy.

4. The electrical contact of claim 1, wherein the contact zone is made of a noble metal.

5. The electrical contact of claim 1, wherein the contact spring is elastically deflectable between the contact zone and the contact region.

6. The electrical contact of claim 1, wherein the aluminum body has no form-fitting elements.

7. The electrical contact of claim 1, wherein the contact zone is positioned on the aluminum body by roll-cladding.

8. The electrical contact of claim 1, wherein the contact spring extends away from a sleeve connected in a form-fitting manner to a free end of the aluminum body.

9. The electrical contact of claim 8, wherein the free end of the aluminum body faces away from the connecting portion.

10. The electrical contact of claim 9, wherein the contact spring is curved around the free end of the aluminum body.

11. The electrical contact of claim 9, wherein an outer surface of the sleeve facing away from the aluminum body is coated with a noble metal.

12. The electrical contact of claim 1, wherein the contact zone is disposed only on a portion of the surface of the aluminum body contacted by the contact spring.

13. The electrical contact of claim 1, wherein the material of the contact spring is coated with a same material as the material of the contact zone.

14. A contact arrangement, comprising:

an electrical contact including an aluminum body extending along a longitudinal axis and formed of an aluminum or an aluminum alloy, a contact zone disposed on a surface of the aluminum body and adapted to be electrically connected to a mating contact, an intermediate layer arranged between the aluminum body and the contact zone, and a contact spring connected to the aluminum body and having a contact region contacting the mating contact, the aluminum body has a connecting portion, the contact zone is formed from a material that is more creep-resistant than the aluminum body, the contact zone is arranged flush with the surface of the aluminum body, the intermediate layer is formed of a different material than the contact zone and the aluminum body, the contact spring at least partially rests on the contact zone and is formed from a material that is harder than the aluminum body, the material of the contact spring is different from the material of the contact zone; and an aluminum conductor connected to the connecting portion in an integrally bonded and/or form-fitting manner.

15. The contact arrangement of claim 14, wherein the aluminum conductor is welded to the connecting portion.

* * * * *